US010118786B2

(12) United States Patent
Qiu et al.

(10) Patent No.: US 10,118,786 B2
(45) Date of Patent: Nov. 6, 2018

(54) APPARATUS WITH AUTOMATIC BELT TENSIONING

(71) Applicants: Maintek Computer(Suzhou) Co., Ltd., Suzhou (CN); PEGATRON CORPORATION, Taipei (TW)

(72) Inventors: Meng-Bin Qiu, Suzhou (CN); Ming-Ta Chiu, Taipei (TW)

(73) Assignees: Maintek Computer (Suzhou) Co., Ltd., Jiang Su (CN); Pegatron Corporation, Taipei (TW)

( * ) Notice: Subject to any disclaimer, the term of this patent is extended or adjusted under 35 U.S.C. 154(b) by 127 days.

(21) Appl. No.: 15/354,477

(22) Filed: Nov. 17, 2016

(65) Prior Publication Data

US 2017/0158450 A1 Jun. 8, 2017

(30) Foreign Application Priority Data

Dec. 7, 2015 (CN) ..... 2015 1 0889768

(51) Int. Cl.

| | |
|---|---|
| ***B65H 23/08*** | (2006.01) |
| ***B65H 23/04*** | (2006.01) |
| ***B65H 16/00*** | (2006.01) |
| *F21V 21/084* | (2006.01) |

(52) U.S. Cl.

CPC ..... *B65H 23/048* (2013.01); *B65H 16/005* (2013.01); *B65H 23/08* (2013.01); *B65H 2402/545* (2013.01); *B65H 2403/946* (2013.01); *F21V 21/084* (2013.01)

(58) Field of Classification Search

CPC .... B65H 23/08; B65H 23/048; B65H 16/005; A62B 33/00

See application file for complete search history.

(56) References Cited

U.S. PATENT DOCUMENTS

| | | | | |
|---|---|---|---|---|
| 3,602,452 | A * | 8/1971 | Sauer | B65H 23/08 242/156 |
| 4,570,870 | A * | 2/1986 | Ito | B41J 15/16 242/156.1 |
| 9,315,352 | B2 * | 4/2016 | Nelson | B65H 23/08 |
| 2002/0050543 | A1 * | 5/2002 | Romes | B65H 16/08 242/422.5 |

(Continued)

FOREIGN PATENT DOCUMENTS

| | | | |
|---|---|---|---|
| CN | 204586774 | U | 8/2015 |
| TW | M380012 | U | 5/2010 |
| TW | M435846 | U1 | 8/2012 |

*Primary Examiner* — Sang K Kim

(74) *Attorney, Agent, or Firm* — Muncy, Geissler, Olds & Lowe, P.C.

(57) ABSTRACT

Provided is an apparatus with automatic belt tensioning. A winding seat includes a first gear and a winding portion fixed at the first gear. A belt is windable around the winding portion, and the first elastic element is connected with the winding portion thus to wind the belt around the winding portion. A rotation preventing element includes a protrusion. When the protrusion retains the first gear, the winding portion is locked to prevent the belt being wound. When the belt is pulled, it drives the protrusion to be separated from the first gear and drives the winding portion to rotate. When the belt is released and the winding speed of the belt is decreased to a certain degree, the protrusion retains the first gear to prevent the belt being wound.

10 Claims, 8 Drawing Sheets

(56) References Cited

U.S. PATENT DOCUMENTS

| | | | | |
|---|---|---|---|---|
| 2003/0094534 | A1 | 5/2003 | Fujii et al. | |
| 2016/0101960 | A1* | 4/2016 | Lam | B65H 23/14 156/577 |

* cited by examiner

APPARATUS WITH AUTOMATIC BELT TENSIONING

CROSS-REFERENCE TO RELATED APPLICATIONS

This application is based upon and claims priority under 35 U.S.C. 119 from China Patent Application No. 201510889768.3 filed on Dec. 7, 2015, which is hereby specifically incorporated herein by this reference thereto.

BACKGROUND OF THE INVENTION

1. Field of the Invention

The invention of this disclosure relates to an apparatus with automatic belt tensioning and, more particularly, to an apparatus with automatic belt tensioning used in a head mount apparatus.

2. Description of the Prior Arts

Conventionally, a belt has to be used for helping mounting a head mount apparatus such as swimming goggles or a head lamp onto a head of a user. The length of the belt can be usually adjusted to be applied to heads of different users. Further, the belt usually has elasticity, and after the belt is stretched to be worn on the head, the contracting force of the belt makes the head mount apparatus firmly mounted onto the head. However, when different users wear the same apparatus, they have to adjust the belt to make the apparatus applied to their own head. Otherwise, the head mount apparatus is easily loosened, or the head of the user may bear too much stress.

In addition, another belt with automatic tensioning has a tensioning mechanism for automatically tensioning the belt after worn. Accordingly, the belt without elasticity can be used, thus greatly increasing selectivity of the material of the belt. In this kind of the belt with automatic tensioning, an elastic element in the tensioning mechanism is usually used to help winding the belt around a roller. When the belt is pulled by the user, the belt is stretched from the roller thus to be capable of being worn on the head of the user. After the belt is released, the belt may be wound around the roller by the elastic element again.

However, in this kind of the belt with automatic tensioning, the tensioning force of the elastic element is proportional to the stretching length of the belt, and therefore the user with a larger head may bear more stress. Further, based on the same principle, the tensioning force of the elastic element reaches the maximum at the moment that the belt is to be released after it is pulled by the user, and therefore the belt may be quickly wound around the roller again. At this moment, the belt may strike the head of the user, thus making the user feel discomfort.

Accordingly, the invention of this disclosure is to provide a better solution to improve the prior art.

SUMMARY OF THE INVENTION

One objective of the invention of this disclosure is to provide an apparatus with automatic belt tensioning to provide a uniform stress for different heads and to buffer the winding speed of the belt at the moment that the belt is released thus to make the user feel comfortable.

To achieve the above objective, the invention provides an apparatus with automatic belt tensioning including a casing, a winding seat, a belt, a first elastic element, a rotation preventing element, and a second elastic element. The winding seat is pivotally contained in the casing and includes a winding portion and a first gear, and the winding portion is disposed on one side of the first gear; the belt is windable around the winding portion, and one end of the belt is fixed at the winding portion and the other end passes through the casing; the first elastic element is contained in the casing and is connected with the winding portion, and the first elastic element releases elastic potential energy to rotate the winding portion to allow the belt to be wound around the winding portion; the rotation preventing element is rotatably contained in the casing and includes a bearing shaft and a protrusion, and the belt is disposed across the bearing shaft from the winding portion and the protrusion is capable of retaining the first gear; the second elastic element is contained in the casing and one end of the second elastic element abuts on the rotation preventing element, and the second elastic element releases elastic potential energy to push the protrusion of the rotation preventing element towards the first gear. When the belt is pulled to be away from the casing, the belt drives the winding portion to rotate and drives the rotation preventing element to rotate to allow the protrusion to be separated from the first gear, thus allowing the first elastic element and the second elastic element to store the elastic potential energy, respectively.

In one embodiment, the first gear may have a plurality of tooth spaces each of which has a steep surface and a flat surface, and the direction in which the steep surface faces may be the same as the rotation direction of the winding portion driven by the belt.

In one embodiment, the rotation preventing element may have a fixed end and a free end opposite to each other, and the rotation preventing element may rotate around the fixed end; the apparatus with automatic belt tensioning may further include a damper disposed at the free end of the rotation preventing element and connected with the winding seat; when the winding seat rotates, the damper may exert a damping force on the winding seat; when the belt is pulled to be away from the casing, the damper may be separated from the winding seat.

In one embodiment, the winding seat may further have a second gear having the same axis with the first gear and fixed at the first gear; the apparatus with automatic belt tensioning may further include a third gear disposed at the free end of the rotation preventing element and connected with the damper, and the third gear may mesh with the second gear; when the winding seat rotates, the damper may exert the damping force on the winding seat via the third gear and the second gear; when the belt is pulled to be away from the casing, the third gear may be separated from the second gear.

In one embodiment, the rotation preventing element may have a first roller rotatably sleeved on the bearing shaft, and the belt may be disposed across the first roller.

In one embodiment, the apparatus with automatic belt tensioning may further include a clamping shaft and a second roller. The clamping shaft may be disposed in the casing, and the second roller may be rotatably sleeved on the clamping shaft and may be capable of clamping the belt together with the first roller; when the belt is pulled to be away from the casing, the first roller and the second roller may release the clamped belt.

In one embodiment, the apparatus with automatic belt tensioning may further include a clamping shaft disposed in the casing and capable of clamping the belt together with the bearing shaft; when the belt is pulled to be away from the casing, the bearing shaft and the clamping shaft may release the clamped belt.

In one embodiment, the apparatus with automatic belt tensioning may further include a second roller pivotally disposed at the clamping shaft and capable of clamping the belt together with the bearing shaft.

In one embodiment, the apparatus with automatic belt tensioning may further include an adjusting element penetrating the casing. The depth of penetration may be adjustable, and the adjusting element may abut on the second elastic element.

In one embodiment, the inner wall of the casing may include at least one groove, and one end of the bearing shaft may be disposed in the groove.

Accordingly, in the apparatus with automatic belt tensioning of the invention, when the belt is pulled by the user, the belt drags the bearing shaft of the rotation preventing element to allow the rotation preventing element to rotate, thus allowing the protrusion of the rotation preventing element to be separated from the first gear. After the belt is released by the user, the winding seat is driven by the tensioning force of the first elastic element to rotate to allow the belt to be wound around the winding seat. The winding speed of the belt may be gradually decreased. Further, the protrusion may still prevent the first gear and the winding seat from rotating, and the damper, the first roller, and the second roller may prevent the belt from moving. Accordingly, the winding speed of the belt may be buffered. In addition, when the winding speed of the belt is decreased to a certain degree, the protrusion retains the first gear to prevent the belt from being wound. Accordingly, for the different heads, the protrusion may retain the first gear when the winding speed is decreased to the same degree thus to provide a uniform stress.

Other objectives, advantages and novel features of the invention will become more apparent from the following detailed description when taken in conjunction with the accompanying drawings.

DETAILED DESCRIPTION OF THE PREFERRED EMBODIMENTS

Certain advantages and innovative features of the invention will become more apparent from the following preferred embodiments.

Figure 1:
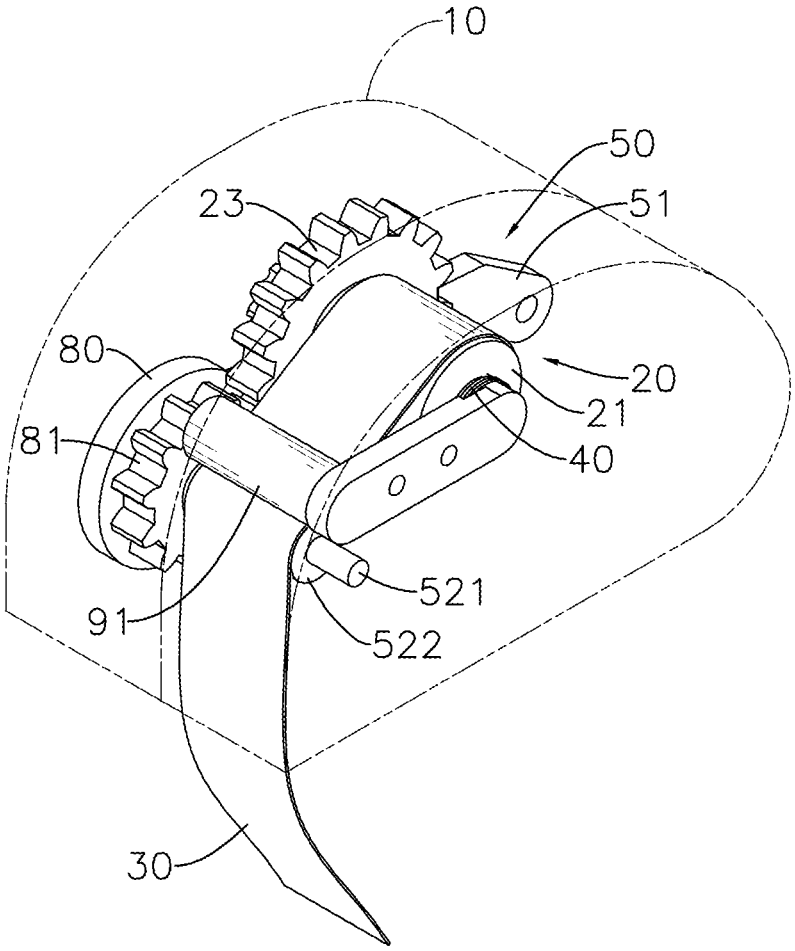
FIG. 1 is a perspective view of an apparatus with automatic belt tensioning according to one embodiment of the invention.
Figure 2:
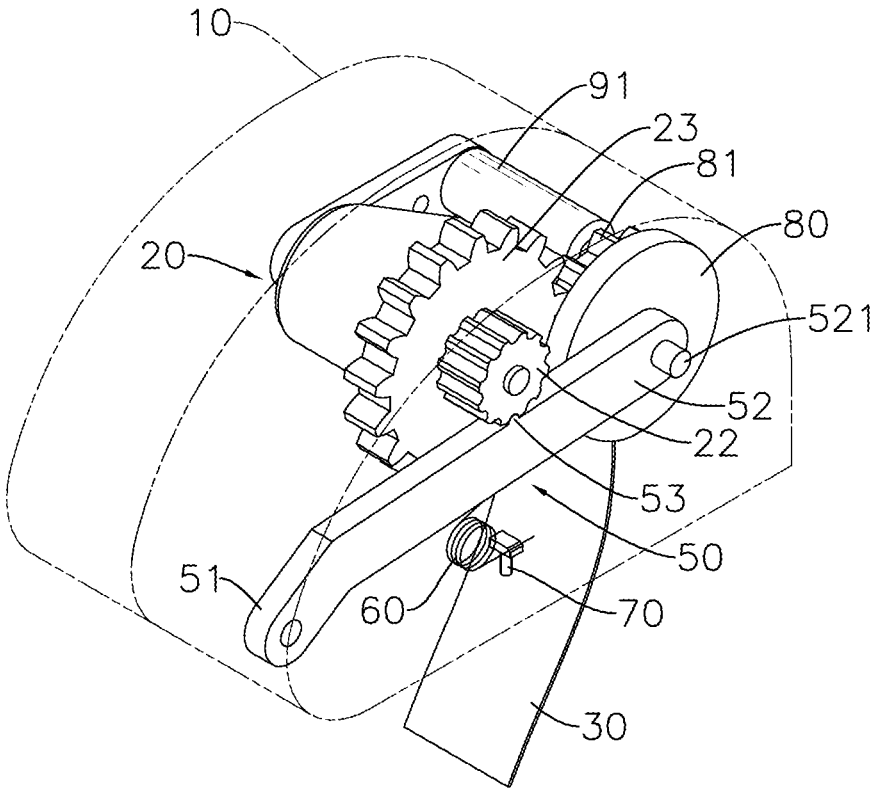
FIG. 2 is another perspective view of the apparatus with automatic belt tensioning according to one embodiment of the invention.
Figure 3:
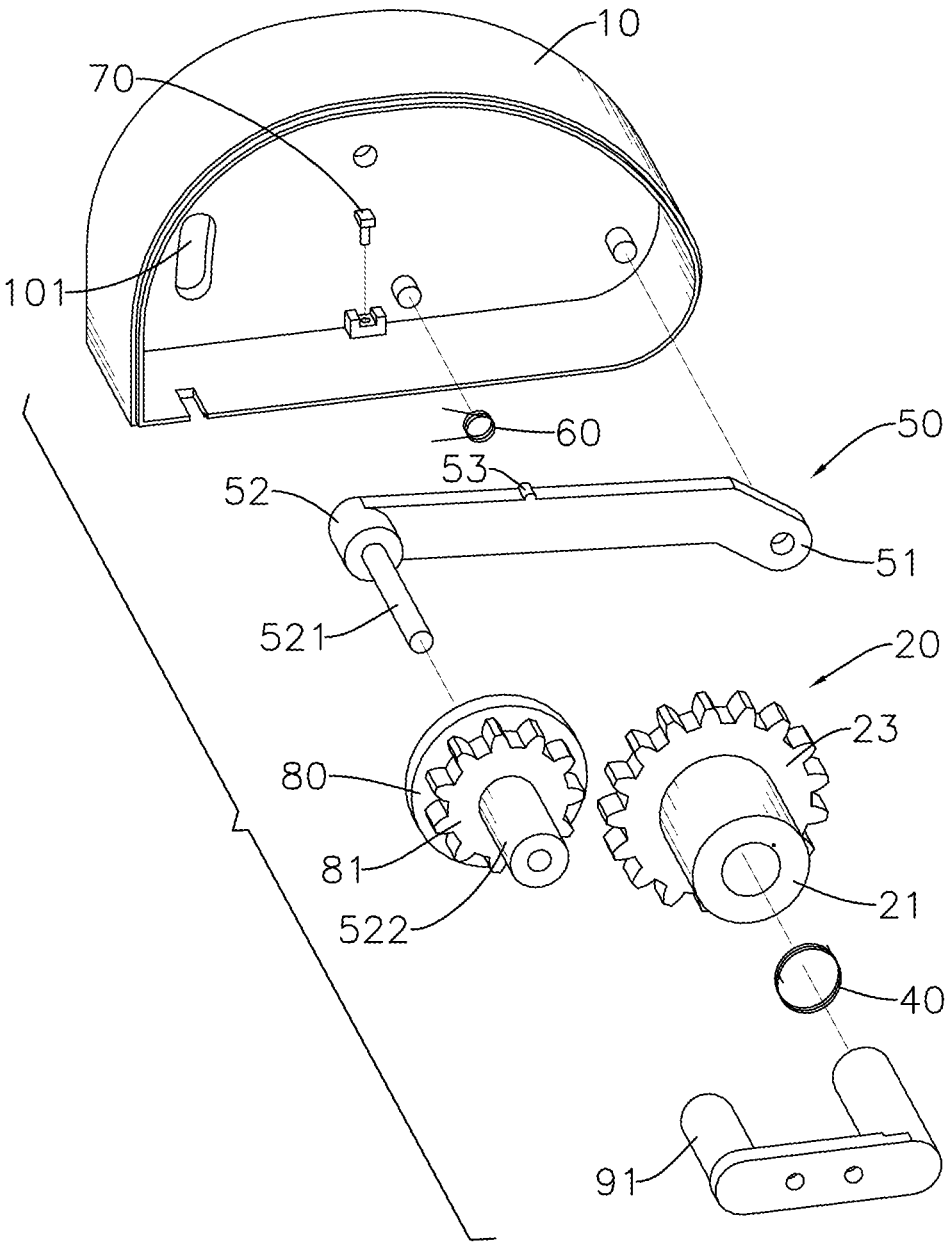
FIG. 3 is an exploded perspective view of the apparatus with automatic belt tensioning according to one embodiment of the invention.

Please refer to FIG. 1, FIG. 2, and FIG. 3. An apparatus with automatic belt tensioning according to one embodiment includes a casing 10, a winding seat 20, a belt 30, a first elastic element 40, a rotation preventing element 50, a second elastic element 60, an adjusting element 70, and a damper 80.

The winding seat 20 is pivotally contained in the casing 10 and is used for bearing the belt 30. The winding seat 20 includes a winding portion 21 and a first gear 22. The winding portion 21 is tubular and further may be cylindrical in detail. However, the winding portion 21 may also be a square tube or a polygonal tube. Further, the winding portion 21 and the first gear 22 has the same axis, and the winding portion 21 may be fixed on one side of the first gear 22 to allow the winding portion 21 to rotate together with the first gear 22 around the same axis. One portion of the belt 30 is contained in the casing 10 and is partly wound around the winding portion 21. In detail, one end of the belt 30 is fixed at the winding portion 21, and the other end passes through the casing 10 and can be pushed by a user. The first elastic element 40 is contained in the casing 10 and is connected with the winding portion 21. For example, the first elastic element 40 may be s torsion spring one end of which is connected with the winding portion 21 and the other end of which is fixed at the casing 10 to allow the winding portion 21 to rotate thus allowing the belt 30 to be wound around the winding portion 21.

When the belt 30 is pulled to be away from the casing 10 by the user, one portion of the belt 30 is pulled out of the casing 10, and the belt 30 drives the winding portion 21 to rotate and then is separated from the winding portion 21 to make the wound portion around the winding portion 21 decreased. Meanwhile, the belt 30 drives the winding portion 21 and the first gear 22 to rotate relative to the casing 10 thus to extend the first elastic element 40 to allow the first elastic element 40 to store elastic potential energy and to provide the winding portion 21 with a tensioning force. When the belt 30 is released by the user, the first elastic element 40 releases the elastic potential energy, and the tensioning force of the first elastic element 40 reversely drives the winding portion 21 and the first gear 22 to rotate thus to allow the belt 30 to be wound around the winding portion 21 again.

Figure 4:
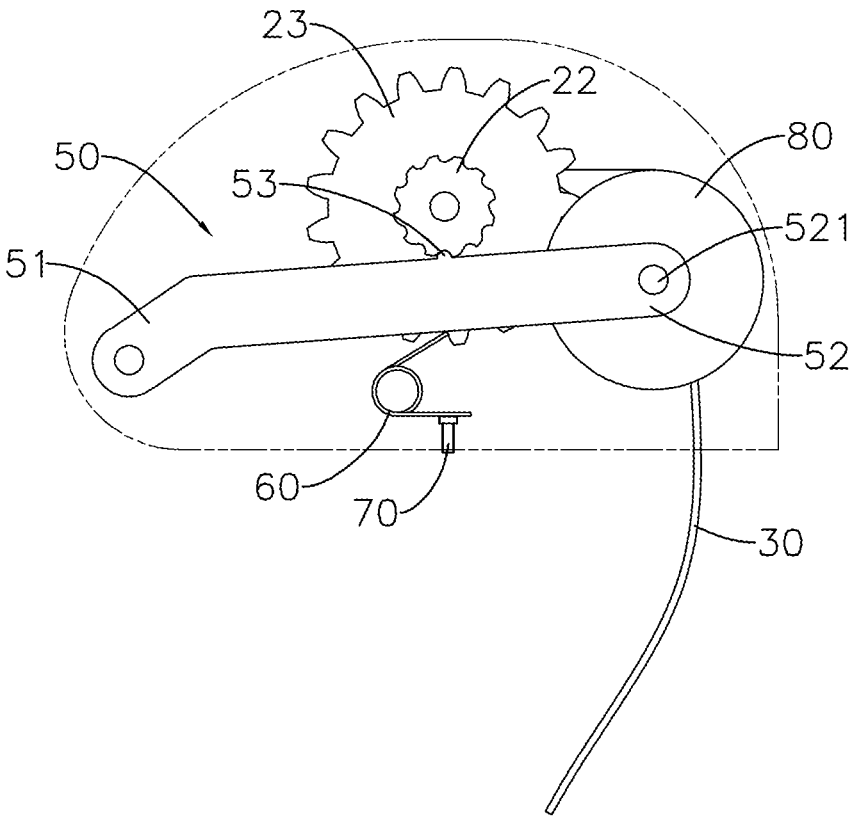
FIG. 4 is a side view before a belt is pulled according to one embodiment of the invention.
Figure 5:
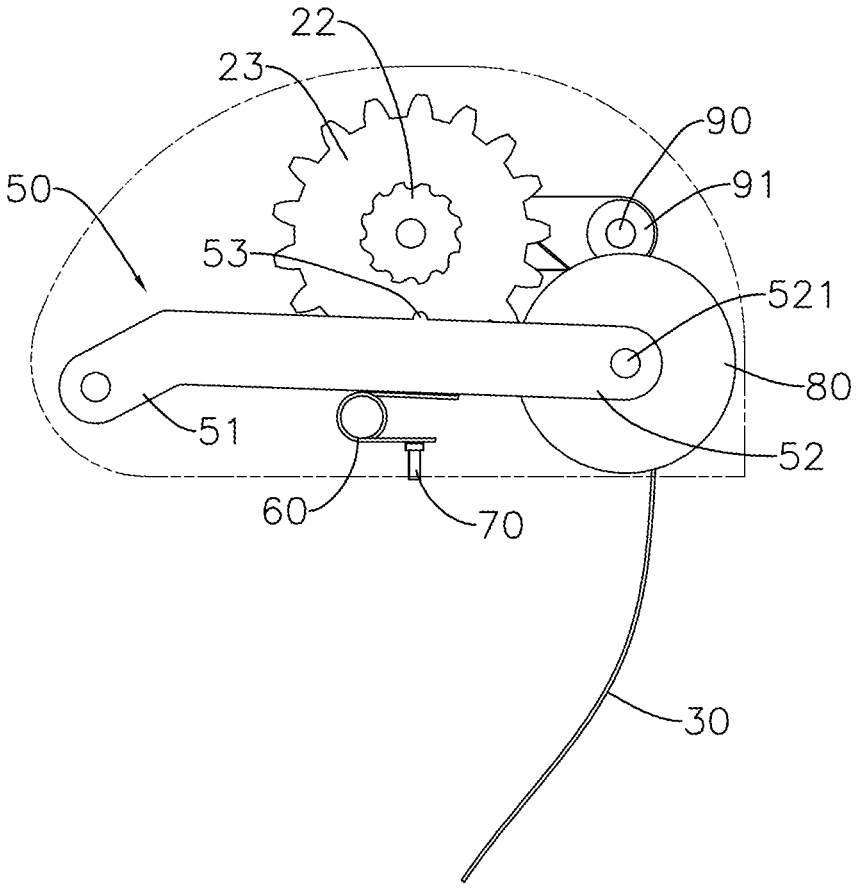
FIG. 5 is a side view after the belt is pulled according to one embodiment of the invention.

Please refer to FIG. 4 and FIG. 5. The rotation preventing element 50 is rotatably contained in the casing 10. The rotation preventing element 50 has a fixed end 51 and a free end 52 opposite to each other, and the rotation preventing element 50 includes a bearing shaft 521 and a protrusion 53. The fixed end 51 is rotatably disposed at the casing 10 to allow the rotation preventing element 50 to rotate around the fixed end 51 relative to the casing 10. The bearing shaft 521 protrudes from the free end 52, and the belt 30 is disposed across the bearing shaft 521 from the winding portion 21, thus allowing the bearing shaft 521 to guide the moving path of the belt 30 in the casing 10.

The inner wall of the casing 10 includes at least one groove 101 (please refer to FIG. 3), and the groove 101 is disposed at the inner wall of the casing 10 in a concave way. One end of the bearing shaft 521 is disposed in the groove 101 and moves only in the groove 101 to limit the rotation range of the rotation preventing element 50. The number of the groove 101 may be two, and the two grooves 101 are used for containing the two ends of the bearing shaft 521, respectively. The two grooves 101 are symmetrical about the center of the bearing shaft 521 in location and shape.

Figure 6:
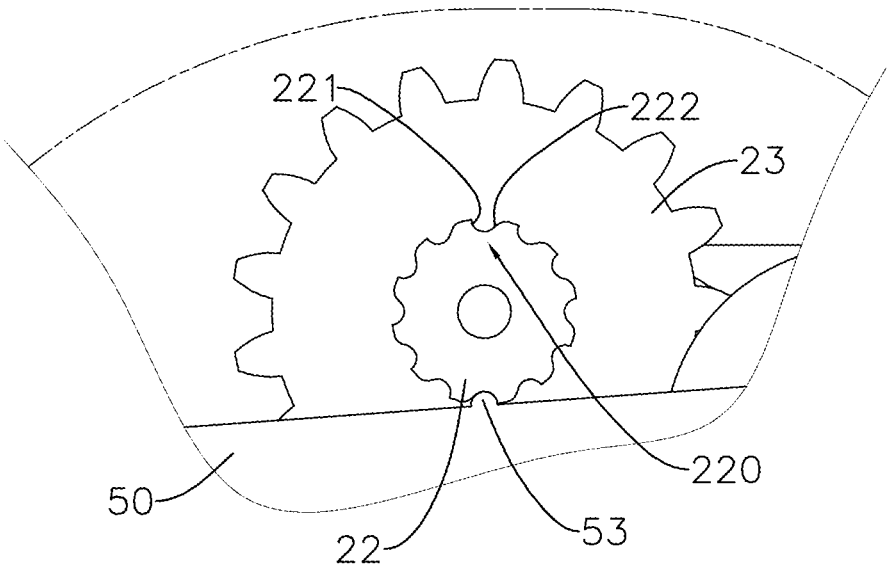
FIG. 6 is a schematic diagram after a protrusion retains a first gear according to one embodiment of the invention.

The rotation preventing element 50 includes a protrusion 53 which is capable of retaining the first gear 22. The first gear 22 has a plurality of tooth spaces 220 (please refer to FIG. 6 together) each of which has a steep surface 221 and a flat surface 222, and the slope of the steep surface 221 is larger than that of the flat surface 222. The direction in which the steep surface 221 faces is the same as the rotation direction of the winding portion 21 driven by the belt 30 when the belt 30 is pulled by the user. When the protrusion 53 retains the first gear 22, the protrusion 53 is located between the steep surface 221 and the flat surface 222 of one of the tooth spaces 220. In detail, the protrusion 53 abuts on the flat surface 222 under the tensioning force of the first elastic element 40.

Accordingly, when the protrusion 53 retains the first gear 22, only a small force is needed to help the protrusion 53 cross the flat surface 222 to allow the belt 30 to be tensioned for an interval of one tooth space 220. Otherwise, a large force may be needed to help the protrusion 53 cross the steep surface 221 to allow the belt 30 to be loosened for an interval of one tooth space 220. In other words, the apparatus with automatic belt tensioning according to the embodiment using this structure is not easily loosened.

The second elastic element 60 may be a torsion spring or a spring contained in the casing 10, and one end of the second elastic element 60 abuts on one side of the rotation preventing element 50 and the other end abuts on the adjusting element 70. The second elastic element 60 is used for pushing the protrusion 53 of the rotation preventing element 50 towards the first gear 22 further to allow the protrusion 53 to retain the first gear 22. However, when the belt 30 is pulled to be away from the casing 10, the force exerting on the belt 30 may be transmitted to the bearing shaft 521. Accordingly, the belt 30 may drive the rotation preventing element 50 to rotate to allow the protrusion 53 to be separated from the first gear 22, and the rotation preventing element 50 may exert a force on the second elastic element 60 to allow the second elastic element 60 to store elastic potential energy. When the user releases the belt 30, the second elastic element 60 releases the stored elastic potential energy to push the protrusion 53 of the rotation preventing element 50 towards the first gear 22. Accordingly, the second elastic element 60 can allow the rotation preventing element 50 to return to the original position, and the protrusion 53 can retain the first gear 22 again.

In the embodiment, the second elastic element 60 is disposed in the direction in which the rotation preventing element 50 rotates, and therefore when the rotation preventing element 50 rotates, the second elastic element 60 is compressed to store the elastic potential energy. However, based on the same principle, when the second elastic element 60 is disposed in the reverse direction, the second elastic element 60 is extended to store the elastic potential energy when the rotation preventing element 50 rotates. This modification may be obvious to one of ordinary skill in the art, and therefore additional drawings are not provided.

In other words, when the belt 30 is pulled by the user, only the tensioning force of the first elastic element 40 may prevent the belt 30 from being unwound, and therefore the belt 30 can be easily pulled. On the other hand, when the belt 30 is released by the user, the belt 30 may be wound around the winding portion 21 by the first elastic element 40 again, and the protrusion 53 retains the first gear 22 again. However, in the process of winding the belt 30 around the winding portion 21, the tensioning force of the first elastic element 40 may be gradually decreased, and therefore the winding speed of the belt 30 may also be gradually decreased.

When the winding speed of the belt 30 is fast, the second elastic element 60 fails to make the protrusion 53 really retain the first gear 22 and only makes the protrusion 53 jump on the first gear 22. At this moment, although the belt 30 continues being wound, the protrusion 53 has already buffered the winding speed. Accordingly, the belt 30 may not directly strike the head of the user. When the winding speed of the belt 30 is decreased to a certain degree, the second elastic element 60 makes the protrusion 53 really retain the tooth space 220 of the first gear 22 thus to lock the first gear 22.

In other words, part of the tensioning force for winding the belt 30 exerted by the first elastic element 40 is offset by the retaining force between the protrusion 53 and the first gear 22 thus to allow the belt 30 to exert a small stress on the head of the user. Accordingly, for the different heads, the first gear 22 may be locked when the winding speed of the belt 30 is decreased to the same degree thus to provide a uniform stress.

Figure 7:
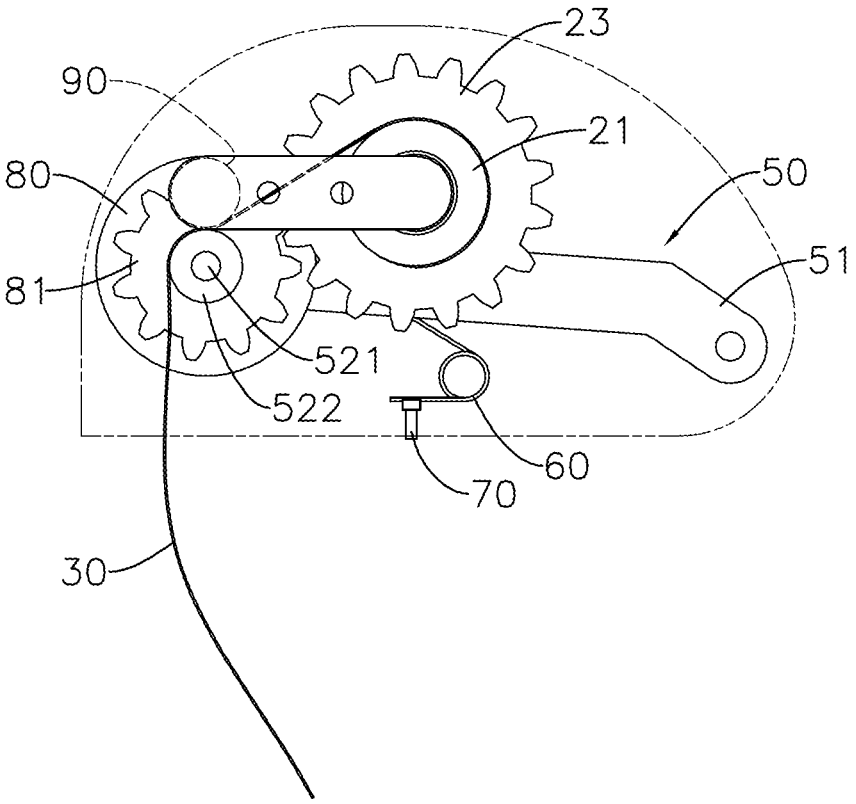
FIG. 7 is another side view before the belt is pulled according to one embodiment of the invention.
Figure 8:
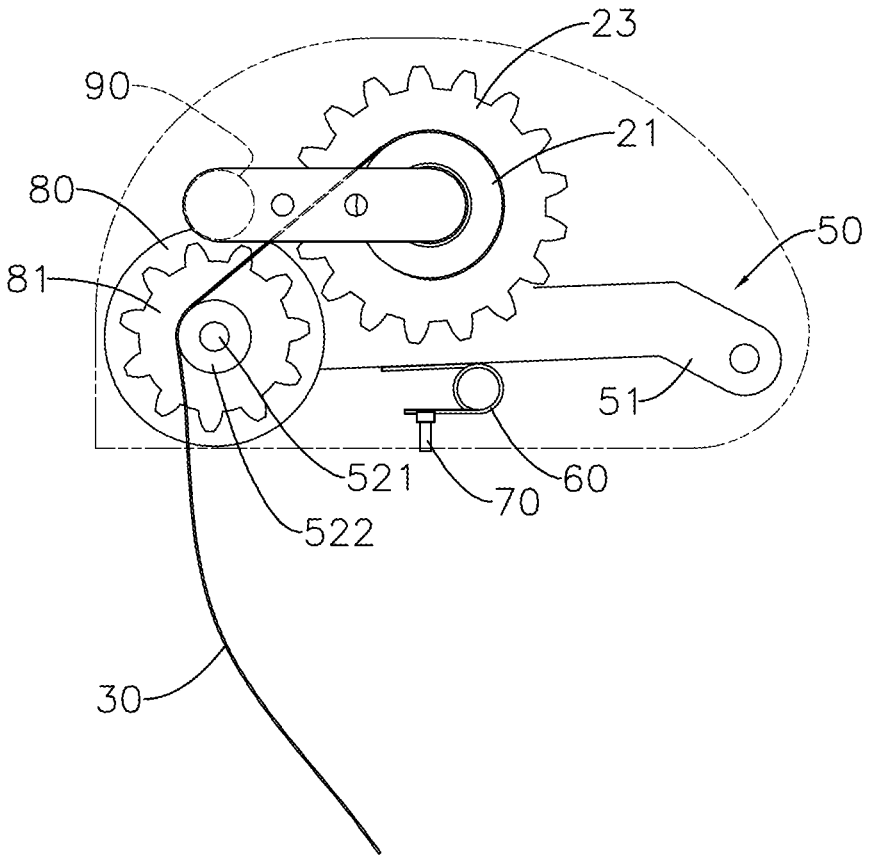
FIG. 8 is another side view after the belt is pulled according to one embodiment of the invention.

Please refer to FIG. 7 and FIG. 8. The damper 80 is disposed at the free end 52 of the rotation preventing element 50 and is connected with the winding seat 20. When the winding seat 20 rotates, the damper 80 exerts a damping force on the winding seat 20 to buffer the winding speed of the belt 30. For example, in the embodiment, the damper 80 may be a rotating damper. However, the invention is not limited thereto.

The winding seat 20 further has a second gear 23 having the same axis with the first gear 22, and the second gear 23 is fixed at one side of the first gear 22. Accordingly, the second gear 23 rotates together with the first gear 22. The axis of the damper 80 is parallel to that of the first gear 22. The apparatus with automatic belt tensioning further includes a third gear 81 disposed at the free end 52 of the rotation preventing element 50. The third gear 81 is connected with the damper 80 and has the same axis with the damper 80, and the third gear 81 rotates around the axis. The third gear 81 meshes with the second gear 23, and therefore when the winding seat 20 rotates, the damper 80 exerts the damping force on the winding seat 20 via the third gear 81 and the second gear 23.

When the belt 30 is pulled to be away from the casing 10, the damper 80 rotates together with the rotation preventing element 50, and therefore the damper 80 is separated from the winding seat 20. In detail, the third gear 81 is separated from the second gear 23. At this moment, the damper 80 may not exert the damping force on the winding seat 20 to allow the belt 30 to be easily pulled by the user. Afterwards, when the belt 30 is released by the user, the rotation preventing element 50 returns to the original position to allow the third gear 81 to mesh with the second gear 23 again, and the tensioning force of the first elastic element 40 drives the winding portion 21 of the winding seat 20 to rotate thus to wind the belt 30. At this moment, the damping force of the damper 80 may be exerted on the winding seat 20 to offset part of the tensioning force thus to buffer the winding speed of the belt 30.

The apparatus with automatic belt tensioning further includes a clamping shaft 90 disposed in the casing 10 and parallel to the bearing shaft 521. When the rotation preventing element 50 does not rotate, the bearing shaft 521 abuts on the clamping shaft 90, and therefore the clamping shaft 90 can clamp the belt 30 together with the bearing shaft 521. When the belt 30 is pulled to be away from the casing 10, the bearing shaft 521 rotates together with the rotation preventing element 50 thus to release the clamped belt 30, and therefore the belt 30 can be easily pulled. Afterwards, when the belt 30 is released, the rotation preventing element 50 returns to the original position to allow the clamping shaft 90 to clamp the belt 30 together with the bearing shaft 521 again, and the clamping force between the clamping shaft 90 and the bearing shaft 521 offsets part of the tensioning force further to buffer the winding speed of the belt 30.

In the embodiment, the bearing shaft 521 of the rotation preventing element 50 includes a first roller 522 rotatably disposed at the free end 52, and the belt 30 is disposed across the first roller 522 of the bearing shaft 521. In addition, the apparatus with automatic belt tensioning further includes a second roller 91 rotatably sleeved on the clamping shaft 90 and capable of clamping the belt 30 together with the bearing shaft 521. In detail, the first roller 522 of the bearing shaft 521 can abut on the second roller 91 thus to clamp the belt 30. The belt 30 is disposed across the first roller 522, and therefore when the bearing shaft 521 is used for guiding the moving path of the belt 30, the damping force of the first roller 522 can be greatly decreased thus to allow the belt 30 to be easily pulled.

In other embodiments, only either the first roller 522 or the second roller 91 can be included. The principle and the effect have been described above, and therefore additional drawings are not provided.

Please refer to FIG. 1 and FIG. 4. The adjusting element 70 penetrates the casing 10, and the depth of penetration of the adjusting element 70 can be adjusted. For example, the adjusting element 70 may be an adjusting knob, and the depth of penetration can be adjusted by rotating the adjusting knob. One end of the adjusting element 70 abuts on the second elastic element 60 and is used for pushing the second elastic element 60 towards the rotation preventing element 50. In other words, the second elastic element 60 is disposed between the rotation preventing element 50 and the adjusting element 70. The other end of the adjusting element 70 is exposed out of the casing 10 for facilitating adjustment of the depth of penetration of the adjusting element 70. The greater the depth of penetration into the casing 10 for the adjusting element 70, the smaller the distance between the rotation preventing element 50 and the adjusting element 70, and further the greater the force from the adjusting element 70 to push the second elastic element 60 towards the rotation preventing element 50.

The greater force for pushing the second elastic element 60 towards the rotation preventing element 50 indicates the greater clamping force between the first roller 522 and the second roller 91 or between the clamping shaft 90 and the bearing shaft 521. Accordingly, the winding speed of the belt 30 can be buffered via the adjusting element 70.

On the other hand, the greater force for pushing the second elastic element 60 towards the rotation preventing element 50 also indicates the more tightly the protrusion 53 retains the first gear 22, further allowing the protrusion 53 to be difficult to jump on the first gear 22. In other words, even if the belt 30 is fast wound, the protrusion 53 still can really retain the first gear 22 thus to prevent the belt 30 from being wound. At this moment, the retaining force between the protrusion 53 and the first gear 22 is great to offset more tensioning force, thus decreasing the stress on the head of the user. In other words, the stress can be controlled by adjusting the adjusting element 70.

To sum up, according to the apparatus with automatic belt tensioning, for different heads, the protrusion 53 can firmly retain the first gear 22 by decreasing the winding speed of the belt 30 to a certain degree. In other words, the retaining force between the protrusion 53 and the first gear 22 can offset the tensioning force of the first elastic element 40 thus to provide a uniform stress. Accordingly, even if different users use the same head mount apparatus with the apparatus with automatic belt tensioning in the embodiments of the invention, the users can be in the same stress without adjusting the length of the belt 30.

In addition, in the process of winding the belt 30, part of the tensioning force of the first elastic element 40 can be offset by the damping force generated when the protrusion 53 jumps over the first gear 22, the damping force of the damper 80, and the clamping force between the clamping shaft 90 and the bearing shaft 521 or between the first roller 522 and the second roller 91, thus buffering the winding speed of the belt 30 to prevent the belt 30 from striking the head of the user.

In addition, the stress exerted on the head of the user by the belt 30 can be automatically adjusted only via the friction of the mechanism itself and without any detecting element. Accordingly, the apparatus with automatic belt tensioning according to the invention has low cost in manufacturing and can be applied in all kinds of dangerous situations.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An apparatus with automatic belt tensioning comprising:

a casing;

a winding seat pivotally contained in the casing and including a winding portion and a first gear, the winding portion being disposed on one side of the first gear;

a belt windable around the winding portion, one end of the belt being fixed at the winding portion and the other end passing through the casing;

a first elastic element contained in the casing and connected with the winding portion, the first elastic element releasing elastic potential energy to rotate the winding portion to allow the belt to be wound around the winding portion;

a rotation preventing element rotatably contained in the casing and including a bearing shaft and a protrusion, the belt being disposed across the bearing shaft from the winding portion and the protrusion being capable of retaining the first gear; and a second elastic element contained in the casing, one end of the second elastic element abutting on the rotation preventing element, and the second elastic element releasing elastic potential energy to push the protrusion of the rotation preventing element towards the first gear;

wherein when the belt is pulled to be away from the casing, the belt drives the winding portion to rotate and drives the rotation preventing element to rotate to allow the protrusion to be separated from the first gear, thus allowing the first elastic element and the second elastic element to store the elastic potential energy, respectively.

2. The apparatus with automatic belt tensioning according to claim 1, wherein the first gear has a plurality of tooth spaces each of which has a steep surface and a flat surface, and the direction in which the steep surface faces is the same as the rotation direction of the winding portion driven by the belt.

3. The apparatus with automatic belt tensioning according to claim 1, wherein the rotation preventing element has a fixed end and a free end opposite to each other, and the rotation preventing element rotates around the fixed end; the apparatus with automatic belt tensioning further comprises a damper disposed at the free end of the rotation preventing element and connected with the winding seat; when the winding seat rotates, the damper exerts a damping force on the winding seat; when the belt is pulled to be away from the casing, the damper is separated from the winding seat.

4. The apparatus with automatic belt tensioning according to claim 3, wherein the winding seat further has a second gear having the same axis with the first gear and fixed at the first gear; the apparatus with automatic belt tensioning further comprises a third gear disposed at the free end of the rotation preventing element and connected with the damper, and the third gear meshes with the second gear; when the winding seat rotates, the damper exerts the damping force on the winding seat via the third gear and the second gear; when the belt is pulled to be away from the casing, the third gear is separated from the second gear.

5. The apparatus with automatic belt tensioning according to claim 1, wherein the rotation preventing element has a first roller rotatably sleeved on the bearing shaft, and the belt is disposed across the first roller.

6. The apparatus with automatic belt tensioning according to claim 5, further comprising a clamping shaft and a second roller, wherein the clamping shaft is disposed in the casing, and the second roller is rotatably sleeved on the clamping shaft and is capable of clamping the belt together with the first roller; when the belt is pulled to be away from the casing, the first roller and the second roller release the clamped belt.

7. The apparatus with automatic belt tensioning according to claim 1, further comprising a clamping shaft disposed in the casing and capable of clamping the belt together with the bearing shaft, wherein when the belt is pulled to be away from the casing, the bearing shaft and the clamping shaft release the clamped belt.

8. The apparatus with automatic belt tensioning according to claim 7, further comprising a second roller pivotally disposed at the clamping shaft and capable of clamping the belt together with the bearing shaft.

9. The apparatus with automatic belt tensioning according to claim 1, further comprising an adjusting element penetrating the casing, the depth of penetration being adjustable, the adjusting element abutting on the second elastic element.

10. The apparatus with automatic belt tensioning according to claim 1, wherein the inner wall of the casing comprises at least one groove, and one end of the bearing shaft is disposed in the groove.

* * * * *